United States Patent [19]

Nalvarian

[11] 4,234,113

[45] Nov. 18, 1980

[54] MANUAL SKI CARRIER

[76] Inventor: Francois J. Nalvarian, 7699 Squirewood Way, San Jose, Calif. 95129

[21] Appl. No.: 962,380

[22] Filed: Nov. 20, 1978

[51] Int. Cl.[2] ..... A63C 11/02

[52] U.S. Cl. ..... 224/45 S; 224/50; 224/257; 211/60 SK; 280/814; 294/103 R

[58] Field of Search ..... 224/45 S, 45 P, 45 R, 224/50, 51, 58, 49, 202, 207, 242, 247, 264, 265; 280/11.37 K, 11.37 A; 211/60 SK; 294/103 R

[56] References Cited

U.S. PATENT DOCUMENTS

| | | | |
|---|---|---|---|
| 3,209,970 | 10/1965 | Canell | 280/11.37 K X |
| 3,747,815 | 7/1973 | Ettl | 224/50 X |

FOREIGN PATENT DOCUMENTS

| | | | |
|---|---|---|---|
| 8616 | 3/1900 | Norway | 280/11.37 A |
| 41353 | 5/1925 | Norway | 280/11.37 A |
| 58027 | 5/1937 | Norway | 280/11.37 A |
| 106947 | 3/1943 | Sweden | 280/11.37 A |
| 133497 | 8/1929 | Switzerland | 280/11.37 A |

*Primary Examiner*—Robert J. Spar
*Assistant Examiner*—Jerold M. Forsberg
*Attorney, Agent, or Firm*—Harry E. Aine; Harvey G. Lowhurst

[57] ABSTRACT

In a manual ski carrier for carrying skis in parallel bottom-to-bottom faced relation, a pair of clamping blocks are carried from a main body member which is laterally directed of the skis. The clamping blocks are preferably spring biased apart such that the inside faces of the clamping blocks engage the opposite side marginal edges of the skis therebetween. A lever having a cam is pivotably affixed to the main body member such that pivoting of the lever causes the cam to engage one of the clamping blocks into clamping relation. The cam is arranged relative to the lever such that when the lever is pivoted away from the skis to a direction extending orthogonally to the skis, the skis may then be carried from the shoulder of the operator by placing the lever over the shoulder. A shoulder strap is preferably employed for connecting the outer end of the lever back to the ski binding, thereby forming a shoulder strap to facilitate carrying the skis. Pivotable connection between the lever and the main body member permits the carrying device to be folded to a compact package for storage and carrying.

8 Claims, 4 Drawing Figures

MANUAL SKI CARRIER

BACKGROUND OF THE INVENTION

The present invention relates in general to manual ski carriers and, more particularly, to a ski carrier of the type which clamps the skis together in parallel bottom-to-bottom faced relation for ease of carrying.

DESCRIPTION OF THE PRIOR ART

Heretofore, manual ski carriers have been proposed wherein the carrying device included a handle secured to a shaft for disposition inbetween a pair of parallel skis faced in bottom-to-bottom relation. A pair of clamping members were affixed to opposite ends of the shaft and a wing nut was carried on the shaft for adjusting the spacing between the clamping members which serve to clamp the marginal side edges of the skis together for holding the skis in parallel relation while being carried. The handle extended parallel to the skis as clamped to the carrier, and the carrier was attached generally at the center of gravity of the skis so that the skis were carried much in the same manner as a suitcase. Such a ski carrier is disclosed in U.S. Pat. No. 3,747,815 issued July 24, 1973.

The problem with such a prior art manual ski carrier is that when skis are carried in the manner of a suitcase, the package becomes relatively long and cumbersome especially when moving in cramped quarters thereby producing a risk of injury to nearby persons as the operator turns for changing direction of movement.

Another problem with the prior art manual ski carrying device is that the clamping action is effected by tightening of a wing nut on a threaded shaft.

The degree of tightness and thus the degree of clamping action is directly related to the ability of the operator to tighten the wing nut. In use, temperatures are typically low and fingers if free to move are often numb such that tightening of the wing nut is difficult in practice.

SUMMARY OF THE PRESENT INVENTION

The principal object of the present invention is the provision of an improved manual ski carrying device.

In one feature of the present invention, the clamping action of the ski carrier is achieved by means of a cam carried on a pivotable lever such that by pivoting the lever, the cam urges the clamping members into clamping locked engagement with the side marginal edges of the skis, whereby clamping of the skis in the carrying position is facilitated in use.

In another feature of the present invention, the lever employed for operation of the clamping device is arranged such that when the skis are clamped together in the carrying position, the lever extends orthogonally from the skis to be placed over the shoulder of the operator such that the skis may be carried from the shoulder of the operator in a more or less vertical orientation, thereby facilitating maneuvering with the skis in crowded areas without risk of injury to nearby persons.

In another feature of the present invention, a carrying strap is affixed between the lever and the skis, thereby forming a shoulder strap to facilitate carrying of the skis from the shoulder of the operator.

In another feature of the present invention, the laterally extending main body member of the ski carrying device comprises a screw threadably mating with a pivot nut on which the cam and lever pivot such that by rotating the lever relative to the screw of the ski carrying device, the lateral spacing between the clamping block portions of the ski carrying device is adjusted thereby facilitating adjustment of the ski carrying device for skis of varying width.

Other features and advantages of the present invention will become apparent upon a perusal of the following specification taken in connection with the accompanying drawings wherein:

DESCRIPTION OF THE PREFERRED EMBODIMENTS

Figure 1:
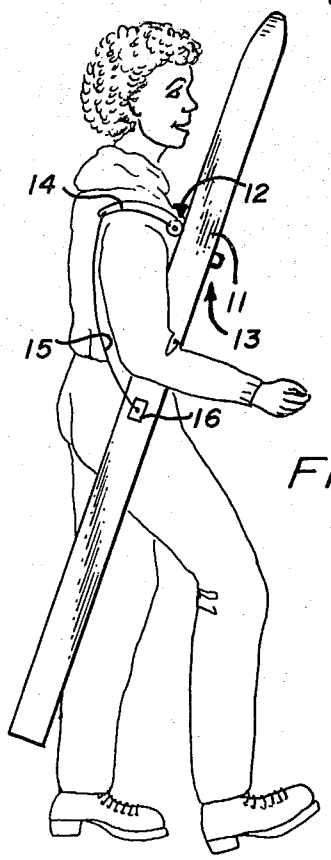
FIG. 1 is a side elevational view of an operator carrying a pair of skis using the manual ski carrying device of the present invention.

Referring now to FIG. 1, there is shown an operator carrying a pair of skis 11 from the shoulder using the manual ski carrier 12 incorporating features of the present invention. More particularly, the ski carrier 12 includes a clamping mechanism 13 operatively associated with a lever or handle 14. The handle 14 is formed and arranged and adapted so as to extend, in one mode of operation, orthogonally from the direction of the longitudinal axis of the skis 11 and has a curved bottom surface to ride on the shoulder of the operator. A shoulder carrying strap 15 extends from the end of the handle to the ski binding 16 to facilitate retention of the handle 14 on the shoulder and thus retention of the shoulder within the shoulder strap. When the skis are clamped by the carrying device 13 near one end of the skis, the center of gravity of the skis serves as a pendulum for swinging the skis into a generally vertical carrying position, as shown, to facilitate maneuvering while the skis are being carried without risk of injury to nearby persons when the operator turns to change direction of movement.

Figure 2:
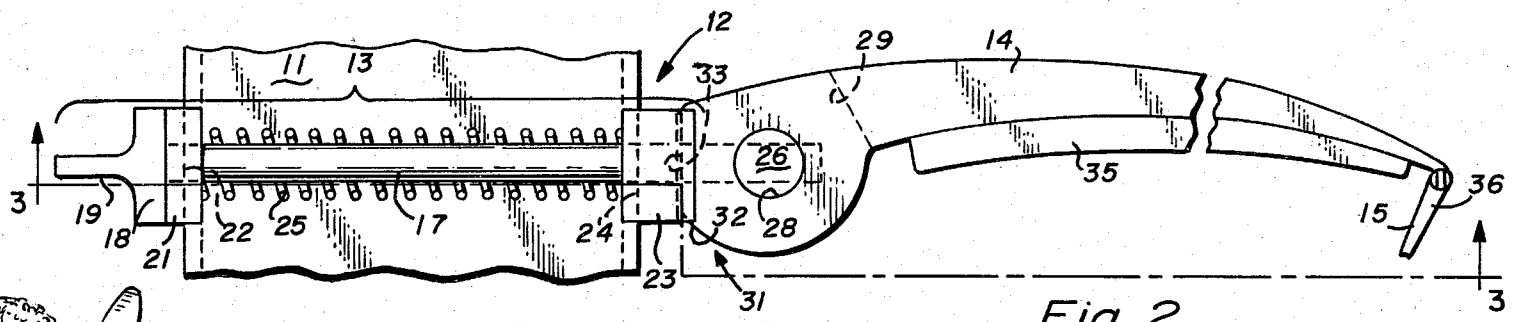
FIG. 2 is a side elevational view, partly broken away of the ski carrying device of the present invention.
Figure 3:
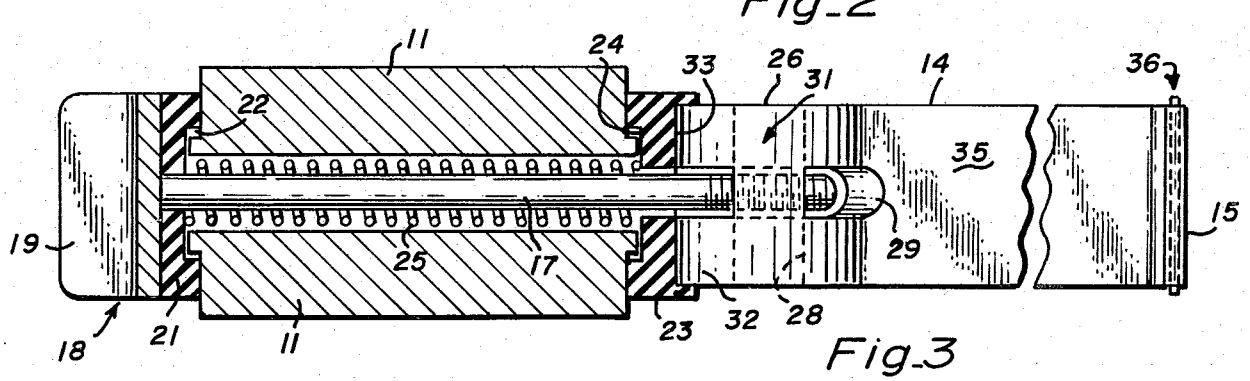
FIG. 3 is a bottom sectional view of the ski carrying device of FIG. 2 taken along line 3—3 in the direction of the arrows.

Referring now to FIGS. 2 and 3, the ski carrying device 12 is shown in greater detail. The carrier 12 includes a main body or thumb screw portion 17 which is located inbetween the mutually opposed bottom surfaces of the parallel skis 11 when the skis are positioned for carrying in the bottom-to-bottom facing relation. A flared thumb hold 18 is fixedly secured to one end of the screw 17 and includes a laterally flared thumb hold portion 19 to be grasped between the thumb and forefinger for turning the screw 17 as desired. A clamping block 21, as of Teflon, is slideably disposed on the screw 17 and includes a rectangular recessed inwardly facing portion 22 to receive the lip side portions of the skis 11.

A second clamping block 23, as of Teflon, is slideably disposed on the other end of the screw 17 and it includes an inwardly facing recessed portion 24 to receive the lip portions of the side edges of the skis 11. A compression spring 25 is disposed surrounding the screw 17 inbetween the clamping blocks 21 and 23 for urging the clamping blocks apart to facilitate initial placement of the skis 11 in position on opposite sides of the screw 17 and inbetween the clamping blocks 21 and 23, respectively.

A pivot nut is threadably mated with the threaded end of the thumb screw 17. The pivot nut comprises a cylindrical axle portion defining a laterally directed pivot axis along its longitudinal axis and has a tapped bore extending therethrough orthogonally to the pivot axis to from a nut for threadably mating with the threaded end of the screw 17. The lever 14 includes a laterally directed bore 28 at one end to pivotably receive the axle portion of the pivot nut 26 for pivoting thereon. A longitudinally directed slot 29 extends into the lever 14 from the pivoted end thereof to bifurcate the end of the lever for passage of the thumb screw 17 therethrough.

The cylindrical pivot nut 26 is inserted within the lateral cylindrical bore 28 in the lever 14 and then the lever 14 with the pivot nut 26 assembled therein is threadably mated with the threaded end of the thumb screw 17 by turning the thumb screw 17. The screw 17 is then turned sufficiently so as to bring the clamping blocks 21 and 23 into engagement with the side marginal edges of the skis 11.

The bifurcated end of the lever 14, at 31, includes an eccentric cam surface which engages the outer facing surface of the adjacent clamping block 23. Cam surface 31 includes a lobe portion 32 and a flat portion 33 so located relative to the longitudinal axis of the lever 14 and the pivot axis of the lever as mounted on the pivot nut 26 so that when the lever 14 is rotated to a position essentially orthogonal to the longitudinal axis of the skis, as shown in FIG. 2, the cam lobe 32 moves to a past dead center locking position, such that the flat portion 33 bears against the clamping block 23 thereby locking the clamping blocks 22 and 23 into clamping engagement with the side marginal edges of the skis. A layer of sponge rubber 35 is affixed to the underside of the lever 14 for riding on the shoulder of the operator. The carrying strap 15 is fastened at one end to the outer end of the lever 14, at 36, and includes a snap fitting of conventional design for coupling the other end thereof to the ski binding 16.

While the preferred mode of operation of the handle is as shown in FIGS. 1 and 2, the handle is also useable for carrying of the skis in the more conventional suitcase manner by pivoting the handle to a position parallel to the skis and tightening the thumb screw 17 for clamping the clamping blocks 22 and 23 against the side marginal edges of the skis.

Figure 4:
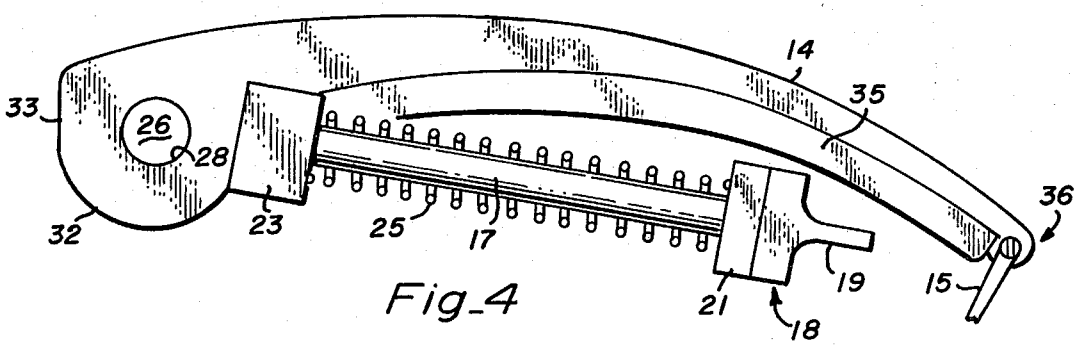
FIG. 4 is a view similar to that of FIG. 2 showing the ski carrying device of the present invention in the folded position for compact storage when not in use.

The pivotable coupling of the thumb screw 17 to the handle 14 also facilitates folding of the device 12 for carrying and storage thereof when not in use, as shown in FIG. 4.

The advantages of the ski carrying device 12 of the present invention include: ability to employ the device for carrying skis in a nearly vertical position, as previously described with regard to FIG. 1, to facilitate maneuvering without risk of injury to nearby persons. In addition, clamping of the ski carrying device 12 to the skis is readily effected by mere rotation of the lever 14 about the pivot nut, which serves to operate the cam for clamping the skis to the lever. Also, the pivotable connection between the lever 14 and the main body portion (thumb screw 17) of the clamping device 12 facilitates compact storage of the ski carrying device when not in use.

As an alternative the lever 14 (handle) may extend orthogonally from the broad faces of the skis as clamped together in bottom-to-bottom facing relation. In this embodiment the lever 14 (handle) as in the previous embodiment as shown in FIG. 1, is formed and arranged to be received on the shoulder of the operator.

As used herein "generally vertical orientation" means closer to the vertical than to the horizontal.

What is claimed is:

1. In a ski carrier for carrying of a pair of skis manually:

main body means for extending laterally of a pair of skis to be carried in parallel bottom-to-bottom facing relation;

side gripping means carried from said main body means for gripping opposite side marginal edges of the skis as the skis are positioned in said parallel relation;

cam means pivotably coupled to said main body means and operatively associated with said side gripping means for operation of said side gripping means for effecting opening and closing of said side gripping means in accordance with pivotable operation of said cam means;

lever means operatively associated with said cam means for effecting operation of said cam means;

said cam means being operatively associated with said side gripping means so that when said lever means is pivoted away from the skis, as positioned in carrying position between said side gripping means, said cam means forces said side gripping means into gripping engagement with the marginal side edges of the skis for clamping the skis together and to said lever means;

said lever means being formed and arranged for extending away from said skis as clamped together in bottom-to-bottom facing relation in a direction generally orthogonally from the longitudinal axis of the skis and generally in a plane parallel to the opposed bottom major faces of said skis as clamped together, said lever means having sufficient length to extend over and to be received over the shoulder of the operator for carrying the skis in a generally vertical orientation when said skis are clamped together by the ski carrier such that the center of gravity of the clamped skis falls generally in a position vertically below the point of engagement of said lever means with the shoulder of the operator.

2. The apparatus of claim 1 including, spring means operatively associated with said main body means and said side gripping means for spring biasing said side gripping means apart and toward their open position, whereby entry of the skis between said side gripping means is facilitated in use.

3. In a manual ski carrying apparatus;

a screw for extending laterally of the skis to be carried when the skis are positioned in a carrying position wherein they are disposed parallel and in bottom-to-bottom facing relation with said screw therebetween;

a pair of clamping blocks carried on said screw for gripping the marginal side edges of the skis therebetween;

a spring carried on said screw between said clamping blocks for spring biasing said clamping blocks apart;

a pivot nut threadably mated to one end of the said screw and having an axle portion extending laterally of the longitudinal axis of said screw;

a cam pivotable on said axle portion of said pivot nut and having a cam surface for engaging one of said clamping blocks for moving said one engaged clamping block along said screw against the spring bias and toward said other clamping block in response to pivoting of said cam on said axle;

a lever to be grasped by the operator and coupled to said cam for pivoting said cam about said pivot axle;

said cam surface being formed and arranged such that when said lever is pivoted away from the skis, said cam causes said clamping blocks to move against the spring bias force into clamping relation with the skis and to clamp the skis together in parallel bottom-to-bottom facing relation;

said lever extending away from said clamped skis generally orthogonally from the longitudinal axis of the skis and generally in a plane parallel to the opposed bottom major faces of said skis, said lever having sufficient length to extend over and to be received over the shoulder of the operator for carrying the skis in a generally vertical orientation when said lever is coupled to said clamped skis such that the center of gravity of the clamped skis falls generally in a position vertically below the point of engagement of said lever with the shoulder of the operator.

4. The apparatus of claim 3 wherein said screw includes a laterally flared end portion forming a thumb hold to be grasped by the hand of the operator for turning said screw in said pivot nut for adjusting the spacing between said clamping blocks.

5. In a ski carrier for carrying of a pair of skis manually:

clamp means for disposition adjacent the skis when disposed in parallel bottom-to-bottom facing relation for holding the parallel skis together as a unit; and handle means for actuating said clamp means, said handle means extending away from said skis generally orthogonally from the longitudinal axis of the skis and generally in a plane parallel to the opposed bottom major faces of said skis as clamped together, said handle means having sufficient length to extend over and to be received over the shoulder of the operator for carrying the skis in a generally vertical orientation when said handle means and said clamp means are coupled to said clamped skis such that the center of gravity of the clamped skis falls generally in a position vertically below the point of engagement of said handle means with the shoulder of the operator.

6. The apparatus of claim 5 including carrying strap means for connection between said handle means and the skis at a point axially displaced from said coupled handle means to provide a loop for receiving the shoulder of the operator and for serving as a shoulder strap to assist in carrying of the skis.

7. The apparatus of claim 5 wherein said handle means has a concave face disposed to ride on the shoulder of the operator.

8. The apparatus of claim 7 wherein said concave face of said handle means is made of a sponge-like material.

* * * * *